United States Patent [19]

Transue

[11] 4,123,983

[45] Nov. 7, 1978

[54] RETRACTABLE NEEDLE BASTING MECHANISM

[75] Inventor: James A. Transue, Union, N.J.

[73] Assignee: The Singer Company, New York, N.Y.

[21] Appl. No.: 852,134

[22] Filed: Nov. 16, 1977

[51] Int. Cl.[2] ..... D05B 55/16

[52] U.S. Cl. ..... 112/221

[58] Field of Search ..... 112/221, 220, 270, 79 R

[56] References Cited

U.S. PATENT DOCUMENTS

| | | | |
|---|---|---|---|
| 3,575,121 | 4/1971 | Berube | 112/221 |
| 3,872,809 | 3/1975 | Adams et al. | 112/221 |

*Primary Examiner*—H. Hampton Hunter

*Attorney, Agent, or Firm*—Edward P. Schmidt; Edward L. Bell; Robert E. Smith

[57] ABSTRACT

For a sewing machine, a needle mechanism selectively retractable to avoid penetration of a work material and to avoid faulty stitch placement. A hollow needle bar telescopically receives and supports in one end thereof a needle carrying mandrel. A flexible rod is carried internally of the needle bar; and is connected at one end to the mandrel, and at the other end to a plug slidably carried by the hollow interior of the needle bar and urged by a spring in a direction away from the mandrel. The flexible rod is formed with a first ear and a second ear, each ear extending laterally therefrom in opposite directions; and is fashioned with a bias to favor engagement of the first ear thereof with the end of a first slot in the hollow needle bar, so as to maintain the needle carried by the mandrel in a position to cooperate with a loop taker of the sewing machine in opposition to the urgings of the spring. Means are provided to deflect the flexible rod inwardly against the bias thereof so as to disengage the first ear of the flexible rod from the end of the first slot. The positioning of the first ear of the flexible rod on the inside diameter of the hollow needle bar will cause the second ear of the flexible rod to protrude through a second slot of the hollow needle bar provided therefor, and impinge on an end of the second slot to maintain the sewing needle in a non-cooperating position with respect to the sewing machine loop taker. A second means are provided to engage with the second ear of the flexible rod while the needle bar is moving upwardly, thereby to draw the flexible rod against the urging of the spring to a position where the first ear will reengage with the first slot in the hollow needle bar, thereby to reinitiate cooperation of the sewing needle with the loop taker of the sewing machine.

7 Claims, 7 Drawing Figures

RETRACTABLE NEEDLE BASTING MECHANISM

BACKGROUND OF THE INVENTION

The invention is concerned with a new basting stitch mechanism for a sewing machine; more specifically, with such a mechanism wherein the sewing needle is retracted from cooperation with a sewing machine loop taker in order to prevent stitch formation.

There are, in the prior art, examples of needle bars for sewing machines which react to the event of striking of an impenetrable object by collapse of the needle bar in order to avoid hazard to the operator or damage to the sewing machine or the work material. Such devices are shown in the U.S. Pat. Nos. 3,799,090 of Sheroff, 3,575,121 of Berube, and 3,471,325 of Berube. In some of the above devices, normal operation of the needle bar is effected automatically, while in others, the needle bar must be manually reset.

There is also in the prior art the U.S. Pat. No. 2,871,810 of Quitter, which discloses a multiple needle sewing machine utilizing a very complicated hollow needle bar arrangement which will permit a needle bar to be withdrawn from operation.

Further, U.S. Pat. No. 3,507,236 of Komuro, discloses an arrangement in a needle bar using screw threads permitting the needle bar to be shortened to interfere with stitch formation. This device requires cessation of operation in order to stop subsequent stitch formation, or in order to reinitiate stitch formation by the sewing needle.

What is required is a device having a selectively retractable needle mechanism which is simple of construction and reliable of operation, and susceptable of automatic disengagement and reengagement in order to effect selective basting.

SUMMARY OF THE INVENTION

The above desired ends are achieved in a sewing machine having a hollow needle bar supporting a needle carrying mandrel, slidable in one end thereof and connected by a flexible rod to a plug slidable in the other end thereof, the plug being urged by a compression spring in an upward direction away from the mandrel. The flexible rod is fashioned with a bias, or bow, in a first direction tending to extend a first transverse ear thereof through a first lengthwise slot in the hollow needle bar and, under the urgings of the spring means bearing against the plug, against the bottom of the first slot where the sewing needle affixed to the mandrel would be in a position to cooperate with a loop taker in the bed of the sewing machine in which the needle bar is supported. A second transverse ear of the flexible rod extends in a direction opposite to the first transverse ear into a second slot in the hollow needle bar. When the first transverse ear of the flexible rod is disengaged from the first slot of the needle bar, against the bias of the flexible rod, the mandrel is drawn inwardly of the needle bar by the spring acting against the plug and, through the flexible rod, on the mandrel; thereby drawing the sewing needle out of cooperative relationship with a loop taker of the sewing machine. The positioning of the first transverse ear of the flexible rod on the inside of the hollow needle bar causes the second transverse ear to protrude beyond the outside diameter of the needle bar. The engagement of the second transverse ear with the bottom of the second slot in the needle bar limits the upward travel of the mandrel within the hollow interior of the needle bar.

The needle bar has affixed thereto the usual driving stud. Additionally, there is a lever block affixed to the needle bar above the driving stud. Two interacting levers are supported on the lever block, a first of which is arranged to displace the first transverse ear of the flexible rod against the bias thereof to permit the sewing needle to be elevated from cooperation with a loop taker. A second lever is arranged to initiate operation of the first lever upon the operation of a third lever supported by the sewing machine frame and activated, for example, by a solenoid. An arming lever is arranged in a position where it will engage the protruding second transverse ear of the flexible rod and, upon elevation of the needle bar, draw the flexible rod to a position where the first transverse ear will reengage itself with the first slot of the needle bar due to the bias imposed by the flexible rod.

DESCRIPTION OF THE DRAWINGS

The many novel features and workings of the present invention will be best understood from the following description of a specific embodiment when read in connection with the accompanying drawings, in which:

Referring to FIG. 2, there is shown the head end portion of a sewing machine 10 partially broken away and with the front cover 12 shown in phantom to permit a viewing of the arrangement of the internal parts thereof. FIG. 1 is an end elevation of the sewing machine shown in FIG. 2 with the front cover 12, pressure regulating module bracket 14 and pressure regulating parts thereon (not shown) removed to show the details of construction of the needle bar gate 18 and a supporting bracket 20 therefore. The support bracket 20 is attached to the head end of the sewing machine by screws 21. A needle bar gate 18 is pivoted to the support bracket 20 on a spherical headed stud 23 and on a spherical ball 24 cooperating with socket 25 affixed by screw 26 to the support bracket. The support bracket 20 has affixed thereto by screw 29 a presser bar bushing 28 which slidably accommodates a presser bar 31 having affixed to an end thereof the presser foot 32. Not shown are the components supported on the pressure regulating module bracket 14 which urge the presser bar 31 and presser foot 32 attached thereto against the feed dog 34, since these components are well known in the art.

Figure 1:
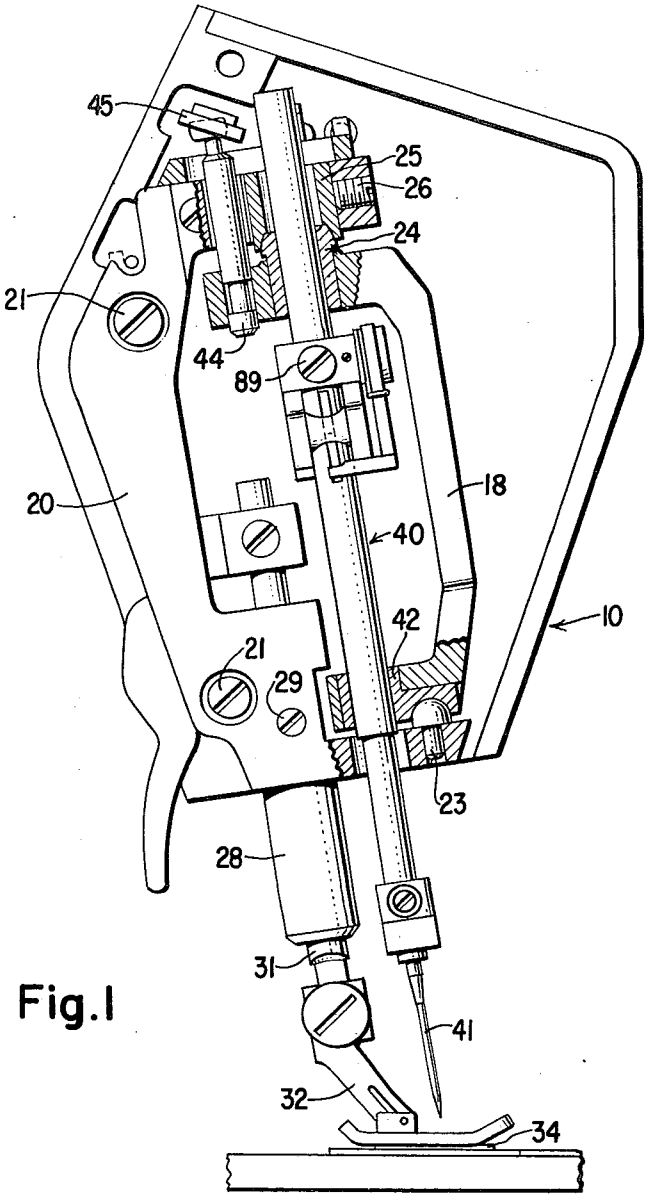
FIG. 1 is a head end elevational view of a sewing machine supported needle bar and gate viewed from the exterior of the sewing machine and showing the relation of the various parts in the head to the invention.

In FIG. 1 there is also shown the retractable needle bar 40 of this invention. The needle bar 40 undergoes endwise reciprocation within an upper bearing fashioned in the spherical ball 24, and a lower bearing 42 carried by the needle bar gate 18, which lower bearing is also formed with a socket for spherical head stud 23. Thus, it is apparent that as the needle bar gate 18 is pivoted on the spherical ball 24 and spherical head stud 23, the sewing needle will undergo the lateral motion necessary to the formation of zig zag stitches. The needle bar gate 18 is made to undergo lateral vibration by means of the post 44, supported thereon, and its connection to driving arm 45 which may be impelled by a variety of devices well known in the sewing machine art, to influence a lateral positioning of the sewing needle 41 required in the formation of ornamental patterns.

Figure 2:
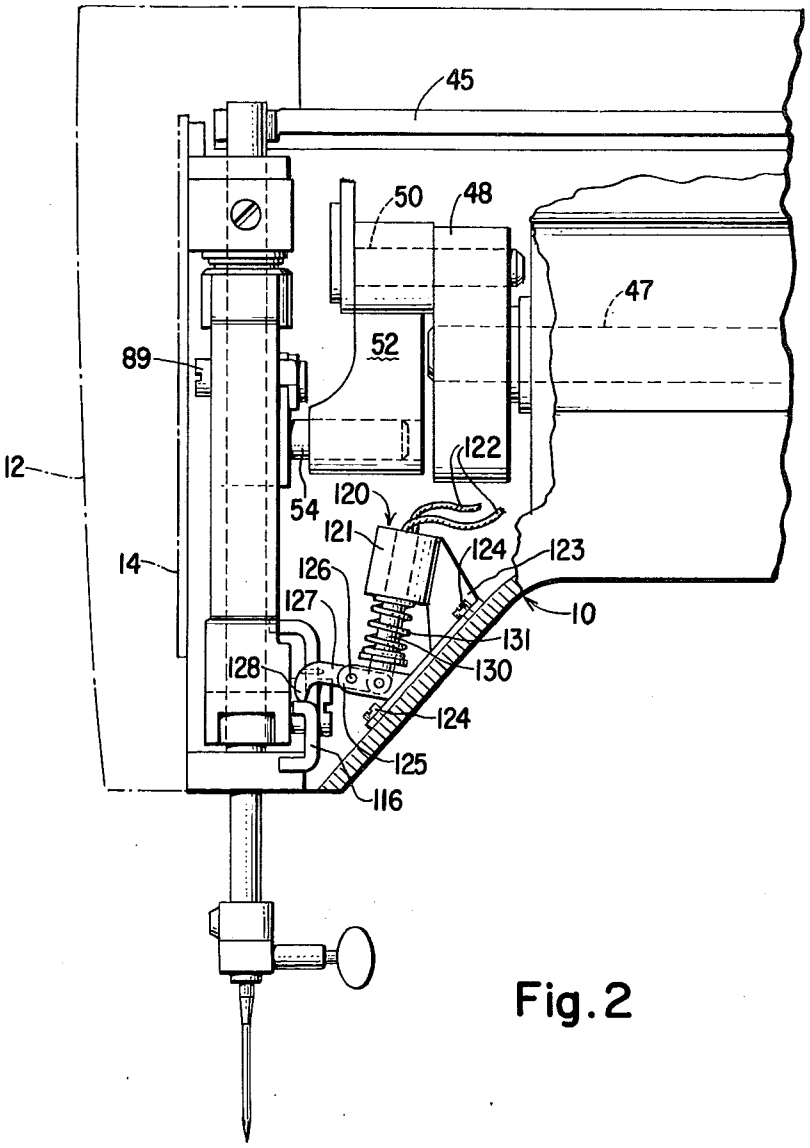
FIG. 2 is front elevational view of the sewing head portion of the sewing machine shown in FIG. 1.

In FIG. 2, there is shown the horizontal arm shaft 47 which terminates in the crank 48 that is connected by pin 50 to connecting link 52 in order to facilitate endwise reciprocation of the needle bar 40 from rotation of the arm shaft 47. The connecting link 52 is drivingly connected to driving stud 54 which is fashioned with a pair cheek pieces 55 which straddle the needle bar 40 and are connected thereto by means of a screw 56 received in a collar 57 extending between the cheek pieces and receiving the needle bar. (See FIGS. 3 and 4) Thus, endwise reciprocation of the retractable needle bar 40 is accomplished whenever the horizontal arm shaft 47 is rotated under the influence of drive means (not shown) for the sewing machine.

Figure 6:
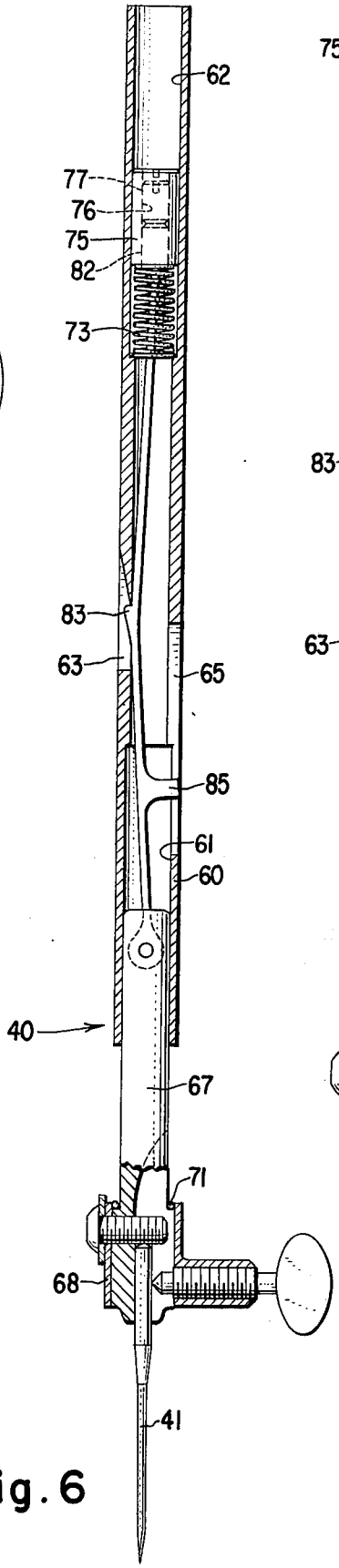
FIG. 6 is cross-sectional view of the needle bar alone showing the mandrel thereof in an extended position to cooperate with a loop taker of a sewing machine; and, FIG. 7 is a cross-sectional view similar to FIG. 6 showing, however, the needle bar in the retracted mode.

Referring to FIG. 6, the retractable needle bar 40 is shown in cross-section to indicate the internal parts thereof. The retractable needle bar 40 includes a hollow tubular portion 60 having counterbores 61, 62 extending inwardly from either end thereof. The lower counterbore 61 slidingly receives a mandrel 67, to the exposed end of which there is connected by the usual clamp 68 the sewing needle 41. The other counterbore 62 of the hollow tubular portion 60 slidably receives a plug 75 bearing against a compression spring 73 seated on the land of the counterbore. The plug 75 is fashioned with internal screw threads 76. A transversely flexible rod 80 extends between the plug 75 and the mandrel 67, the flexible rod having a threaded connection with the internal screw threads 76 of the plug and a pivoted connection with the mandrel 67 by means of pin 81 extending through the mandrel and end of the rod and spanning a slot 69 in the end of the mandrel. The threaded connection of the flexible rod 80 to the plug 75 is locked by a set screw 77, also carried by the internal screw threads 76 of the plug and abutting the end of the flexible rod.

The flexible rod 80 is fashioned with a first transverse ear 83 and a second transverse ear 85, both extending in opposite directions from each other and both normal to the pivot pin 81. The hollow tubular portion 60 is fashioned with a first slot 63 and a second slot 65 to accommodate, respectively, the first transverse ear 83 and second transverse ear 85 of the flexible rod 80. The flexible rod 80 is fashioned with a bias implemented by a bow therein which causes the first ear 83 thereof to extend through the first slot 63 of the hollow tubular portion 60 whenever aligned therewith. With the first ear 83 of the flexible rod 80 extending through the first slot 63 of the hollow tubular portion 60, the second transverse ear 85 extends into the second slot 65 of the hollow tubular member, without however extending externally thereof.

Figure 7:
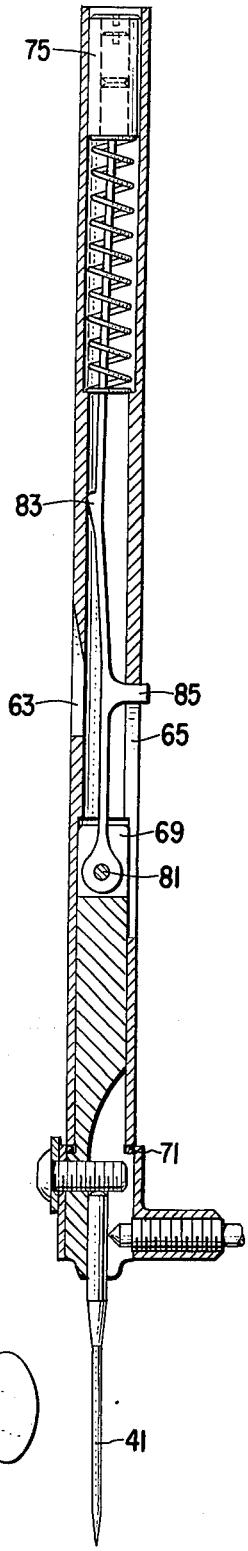

Referring to FIG. 7, there is shown the retractable needle bar 40 with the mandrel 67 thereof drawn inwardly of the hollow tubular portion 60 so as to withdraw the sewing needle 41 from cooperation with the loop taker of the sewing machine. In order to retract the mandrel 67 to the interior of the hollow tubular member 60, the first ear 83 of the flexible rod 80 must be urged inwardly against the bias of the flexible rod. The transverse repositioning of the first ear 83 of the flexible rod 80 will cause the second ear 85 thereof to extend through the slot 65 in the hollow tubular member 60. Under the urgings of the compression spring 73 the entire assembly of the plug 75 flexible rod 80, and mandrel 67 will be repositioned upwardly within the hollow tubular member 60 until the second transverse ear 85 of the flexible rod 80 abuts the end of the second slot 65 in the hollow tubular member. A resilient compression ring 71 may also be supported on the mandrel 67 in a position to abut the end of the hollow tubular member 60 in order to provide a shock cushion when the needle bar assembly 40 is placed in the retracted mode. In order to reestablish the needle bar assembly 40 in the extended mode with the sewing needle 41 extended for cooperation with the loop taker of a sewing machine, it is necessary to cause the second transverse ear 85 of the flexible rod 80 to move relative to the hollow tubular member 60 in order to permit the first transverse ear 83 of the rod to reengage with the end of first slot 63 of the member. The necessary means for accomplishing the retraction and extension of the needle bar assembly 40 is shown in FIGS. 3 and 4.

Figure 4:
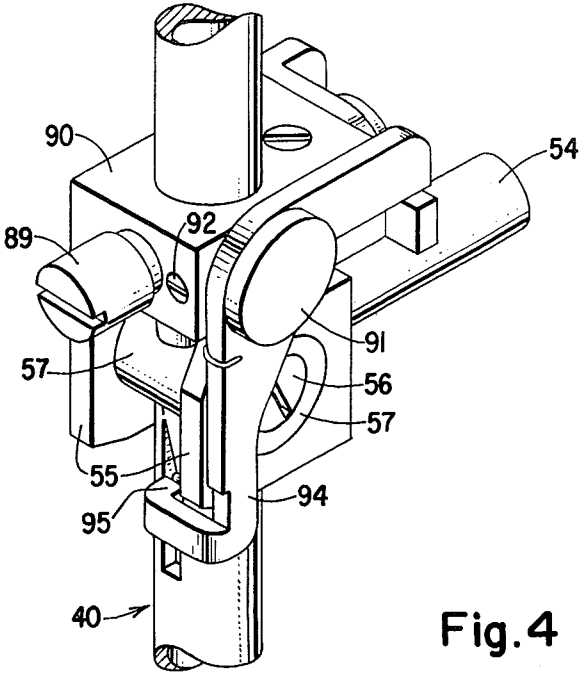
FIG. 4 is perspective view of the upper half of the needle bar taken from another direction to that shown in FIG. 3 to clearly point out the operation of the retraction lever.
Figure 3:
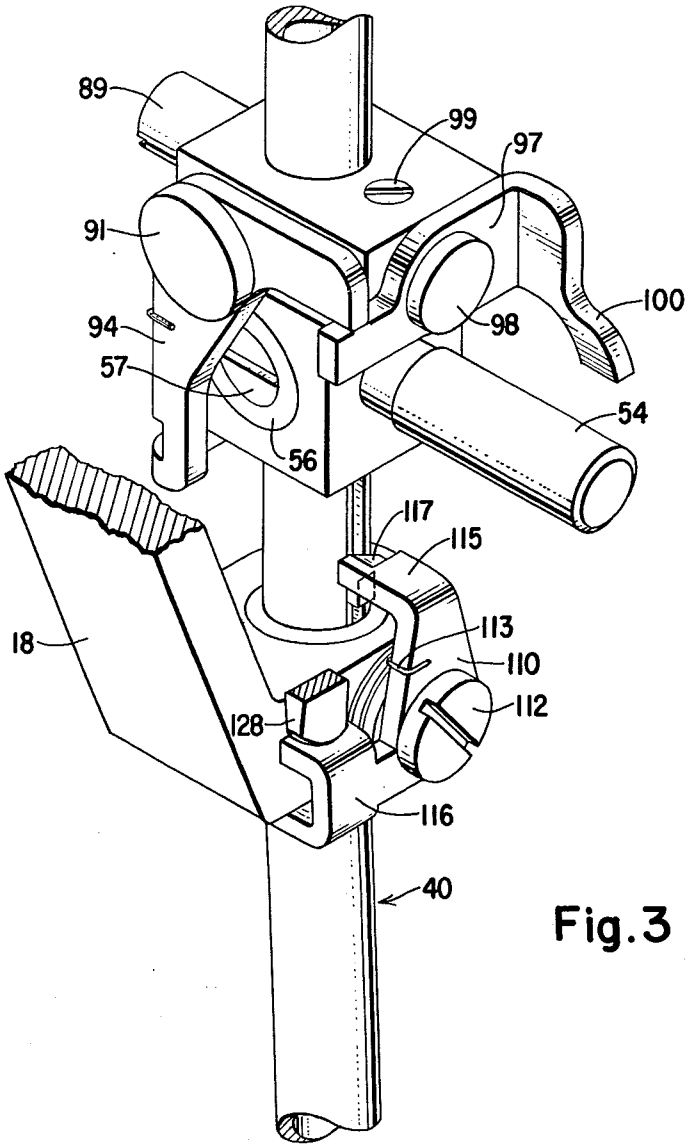
FIG. 3 is a perspective view of the upper half of the needle bar and gate showing the lever arrangement for retraction of the needle and for recocking thereof.

Referring to FIGS. 3 and 4, there is shown the needle bar assembly 40, and the driving stud 54 and collar 57 affixed thereto by screw 56. Also affixed to the needle bar assembly 40 by means of screw 89 is a lever block 90 positioned adjacent the cheek pieces 55 of the driving stud 54. The lever block 90 carries on a shouldered eccentric stud 91, affixed thereto by a screw 92, a retraction lever 94. The retraction lever 94 is fashioned with a lug extension 95 arranged to engage on counterclockwise rotation of the retraction lever with the first ear 83 of the flexible rod 80, thereby to urge the first ear inwardly against the bias of the flexible rod. On an adjacent side of the lever block there is arranged an interposer lever 97, pivoted on a shouldered accentric stud 98 attached to the block by set screw 99, which interposer lever on clockwise rotation urges the retraction lever 94 in the counterclockwise direction required to separate the first ear 83 of the flexible rod 80 from the first slot 63 of the hollow tubular member 60.

Figure 5:
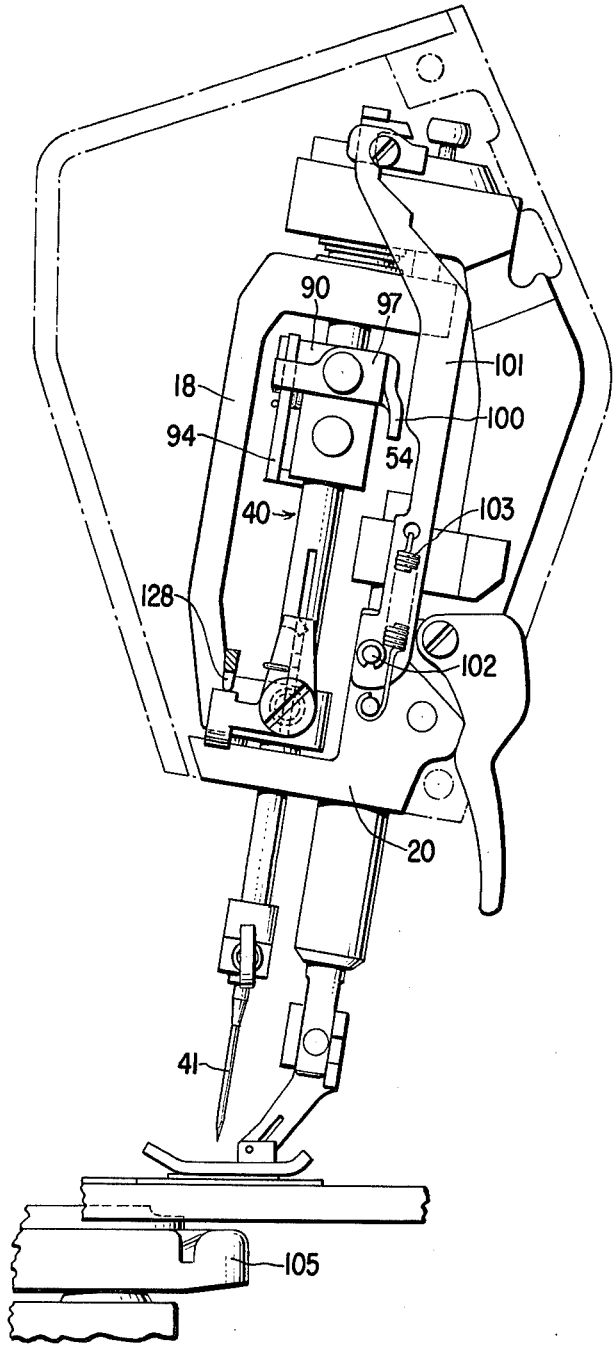
FIG. 5 is an elevational view of the sewing head portion detatched from the sewing machine and viewed from the interior of the sewing machine, i.e., viewed from a direction opposite to that of FIG. 1.

Referring the FIG. 5, there is shown the relationship of the interposer lever 97 to an unlatching bracket 101 pivoted to the support bracket 20 on pin 102 and normally retained in an ineffective position by extension spring 103. The unlatching bracket 101 may be urged in a counterclockwise direction, as shown in FIG. 5, against the urgings of the extension spring 103 by means of a solenoid, thereby to interfere with the upward travel of laterally extending ear 100 of the interposer lever 97. Further particulars on the arrangement of the solenoid to urge the unlatching bracket 101 in a counterclockwise direction may be had by reference to the U.S. Pat. No. 3,872,809, assigned to the same assignee as the instant invention, which is hereby incorporated by reference and made a part of the application. The interference between the laterally extending ear 100 of the interposer lever 97 and the unlatching bracket 101 will cause the interposer lever to rotate in a clockwise direction as viewed in FIGS. 3 and 5, thereby causing the retraction lever 94 to rotate in a counterclockwise direction as viewed in FIG. 3. The counterclockwise movement of the retracting lever 94 causes the lug extension 95 thereof to urge the first ear 83 of the flexible rod 80 into the hollow interior of the hollow tubular member 60 and out of engagement with the first slot 63 thereof. The second transverse ear 85 of the flexible rod 80 will thereby protrude from the hollow tubular member 60 through the second slot 65 thereof. The compression spring 73 will urge the plug 75 and the flexible rod 80 in an upwardly direction until the second transverse ear 85 engages with the end of the slot 65 in the hollow tubular member 60. Thus, the sewing needle 41 of the retractable needle bar assembly 40 will be retracted to a position where it will not cooperate with a loop taker 105 in the formation of stitches.

Extension of the sewing needle 41 to a position for cooperation with the loop taker 105 is attained by moving the second transverse ear 85 of the flexible rod 80 with respect to the hollow tubular member 60 so that the first transverse ear 83 thereof may reengage with the first slot 63 of the hollow tubular member. In order to accomplish this purpose, an arming crank 110 is provided (see FIG. 3). The arming crank 110 is pivotally supported on a shouldered screw 112 attached to the needle bar gate 18 at its lower extremity adjacent the needle bar assembly 40. Arranged about the shouldered screw 112, and biased between the arming crank 110 and the needle bar gate 18 is a torsion spring 113 for normally urging the arming lever to an inoperative position. In FIGS. 3 and 5, the arming crank 110 is shown in an operative position, where a laterally extending arm 115 thereof is arranged in the path of endwise reciprocation of the retractable needle bar assembly 40 and the second transverse ear 85 of the flexible rod 80 which protrudes therefrom when the needle bar assembly is in the retracted state.

Referring to FIG. 2, there is shown a solenoid assembly 120, comprising a solenoid 121 having electrical leads 122 and carried by a solenoid mounting bracket 123 attached in the head end of the sewing machine by screws 124. A pair of upstanding ears 125 part of the mounting bracket 123 pivotably supports on pin 126 extending therebetween a lever 127 having a finger end 128 thereof arranged for cooperation with a forwardly extending leg 116 of the arming crank 110. The forwardly extending leg 116 of the arming crank 110 is fashioned in a U-shape having a portion thereof underlying the needle bar gate 18 so as to limit the clockwise movement of the arming crank 110 under the urgings of the torsion spring 113 when not shown in the operative positions illustrated in FIGS. 2, 3 and 5. The end of the lever 127 opposite the finger end 128 is pivotably connected to a slotted end of the solenoid armature 130, which upon activation of the solenoid 121, causes the finger end 128 of lever 127 to impinge on the forwardly extending leg 116 of the arming crank 110. A coil spring 131 surrounds the solenoid armature 130, and is biased between the solenoid housing and a washer affixed to the solenoid armature, so as to cause the solenoid armature to extend from the solenoid when not activated by current passing through the solenoid leads 122 so as to remove the finger end 128 of the lever 127 from engagement with the forwardly extending leg 116 of the arming crank 110. In this event, the arming crank 110 rotates clockwise as viewed in FIGS. 2 and 3 under the urgings of the torsion spring 113 until restrained by that portion of the forwardly extending leg 116 extending beneath the needle bar gate 18. The laterally extending arm 115 of the arming crank 110 is fashioned on the tip thereof with a ramp 117 designed to accommodate a counterclockwise rotation of the arming crank in the event that the second transverse ear 85 of the flexible rod 80 is situated above the arming crank when the arming crank is rotated into its operative position. Thereafter, on upward reciprocation of the retractable needle bar assembly 40, the laterally extending arm 115 of the arming crank 110 may impinge on the second transverse ear 85 of the flexible rod to maintain the position thereof as the hollow tubular member continues its upward reciprocation, thereby permitting the first transverse ear 83 of the flexible rod to reengage with the first slot 63 of the hollow tubular member 60. By an inspection of FIGS. 1, 2 and 3, it will be noted that the finger end 128 of the lever 127 engages with the fowardly leg 116 of the arming crank 110 closely approximate the pivot point established by the spherical headed stud 23. Thereby, re-extension of the retractable needle bar assembly 40 is relatively insensitive to the lateral position of the sewing needle 41.

Thus has been disclosed a simple retractable needle bar assembly 40 utilizing relatively few components of simple construction supported internally of a hollow tubular member 60. There has also been disclosed a relatively simple means for influencing a retraction of the sewing needle 41 from a position cooperating with a sewing machine loop taker 105, and an equally simple method for reinstating cooperation of the sewing needle with the loop taker. All parts of this device are susceptible of manufacture by mass production techniques well within the skill of the art. Those parts such as the mandrel 67, plug 75 and hollow tubular member 60 which require relatively good sliding fits and finishes are readily fashioned by any of a variety of well known manufacturing techniques. The simplicity of the device, lends itself to low manufacturing costs and to extremely high reliability of operation thereof. Other methods of influencing retraction and extension of the retractable needle bar assembly 40 will suggest themselves to those skilled in the art, however, in this disclosure the presently preferred form of obtaining the retraction and extension has been disclosed. What is taken as the invention is set forth in the claims below.

Having thus set forth the nature of the invention, what is sought to be claimed is:

1. A needle bar assembly for a sewing machine having a frame, actuating means, and a loop taker supported within said frame and driven by said actuating means, said needle bar assembly comprising:

a hollow needle bar supported by said frame for endwise reciprocation by said actuating means;

a mandrel slidably carried in one end of said hollow needle bar;

a sewing needle affixed to said mandrel;

means for supporting said mandrel in a first position where said sewing needle cooperates with said loop taker in the formation of stitches and in a second position where said sewing needle does not cooperate with said loop taker, said supporting means including a flexible rod pivotably attached to said mandrel internally of said hollow needle bar and resilient means for urging said flexible rod and said mandrel to said second position; and, means for selectively initiating movement of said flexible rod and said mandrel from said first position to said second position for a selected number of endwise reciprocations of said needle bar and a return from said second position to said first position during the formation of at least one basting stitch.

2. A needle bar assembly as claimed in claim 1 wherein said hollow needle bar is fashioned with first and second longitudinal slots on opposite sides thereof and wherein said flexible rod is fashioned with first and second ears extending transversely therefrom on opposite sides thereof, said first ear extending through said first slot and urged to an extreme position in an end of said first slot by said resilient means in said first position of said supporting means.

3. A needle bar assembly as claimed in claim 2 wherein said flexible rod is formed with a lateral bias tending to extend said first ear thereof through said first slot of said hollow needle bar.

4. A needle bar assembly as claimed in claim 3 further comprising a lever block attached to said hollow needle bar, a lever pivoted on said lever block and having a lug extension thereof arranged to extend in said end of said first slot of said hollow needle bar, and wherein said initiating means includes means for rotating said lever into engagement with said first ear of said flexible rod for disengagement of said first ear with said first slot and for influencing extension of said second ear of said flexible rod through said second slot of said hollow needle bar beyond the external dimension thereof.

5. A needle bar assembly as claimed in claim 4 wherein said second position to which said flexible rod and said mandrel is urged by said resilient means is determined by said second ear of said flexible rod abutting an end of said second slot in said hollow needle bar.

6. A needle bar assembly as claimed in claim 5 wherein said initiating means further includes an arming crank pivotably carried by said sewing machine frame adjacent said hollow needle bar selectively in an arming position in the path of motion of said second ear protruding therefrom and in a position not in said path, means for biasing said arming crank normally to said position not in said path, and means for selectively pivoting said arming crank to an arming position in said path of motion of said second ear of said flexible rod to retain said second ear against endwise reciprocation with said hollow needle bar, whereby said second ear, flexible rod and mandrel are moved relative to said hollow needle bar to said first position where said first ear of said flexible rod is re-engaged with said first slot of said hollow needle bar.

7. A needle bar assembly as claimed in claim 6 wherein said arming crank is fashioned with a ramp, on an upper surface thereof, and a catch on a lower surface thereof, said ramp being arranged in the path of motion of said second ear when said arming crank is in said arming position, whereby said second ear of said flexible rod impinging on said ramp deflects said arming crank to allow said second ear to engage with said catch for drawing said flexible rod and said mandrel to said first position.

* * * * *